United States Patent [19]

Brezee et al.

[11] Patent Number: 5,015,201

[45] Date of Patent: May 14, 1991

[54] WIRING DEVICE WITH IMPROVED PUSH-WIRE TERMINATION RELEASE

[75] Inventors: Victor L. Brezee; Edward B. Hubben, both of New York, N.Y.

[73] Assignee: Pass & Seymour, Inc., Syracuse, N.Y.

[21] Appl. No.: 481,187

[22] Filed: Feb. 20, 1990

[51] Int. Cl.[5] ..... H01R 4/24

[52] U.S. Cl. ..... 439/441; 439/650

[58] Field of Search ..... 439/438, 441, 389, 650, 439/535, 536

[56] References Cited

U.S. PATENT DOCUMENTS

| | | | |
|---|---|---|---|
| 3,138,421 | 6/1964 | Locher et al. | 439/440 |
| 3,152,851 | 10/1964 | McLaughlin | 439/441 |
| 3,977,751 | 8/1976 | Sahrbacker | 439/441 |
| 4,149,766 | 4/1979 | Stenz et al. | 439/441 |

*Primary Examiner*—David L. Pirlot

*Attorney, Agent, or Firm*—Charles S. McGuire

[57] ABSTRACT

An electrical wiring device having a housing with a first set of openings through which the bare ends of conductors are pushed to effect so-called push-wire connection of the conductors to terminals within the housing in the usual manner. A second set of openings is provided adjacent the first set and a reciprocally slidable member is positioned within each of the second set of openings. Using a small tool, the slidable members may be pushed inwardly to contact and move the spring clip holding the conductor in firm engagement with the terminal, thereby releasing the conductor and permitting its withdrawal from the wiring device. The slidable members include a central stem portion with protrusions extending outwardly in opposite directions adjacent the two ends thereof. The slidable members are configured to cooperate with portions of the wiring device in such a way that movement is constrained to a predetermined path between inner and outer limits.

9 Claims, 4 Drawing Sheets

WIRING DEVICE WITH IMPROVED PUSH-WIRE TERMINATION RELEASE

BACKGROUND OF THE INVENTION

The present invention relates to means for connecting and disconnecting electrical conductors to and from wiring devices and, more particularly, to wiring devices having novel and improved means for push-wire type connection and release of conductors.

Wiring devices such as wall switches, receptacles, and the like, are adapted for connection in a wiring circuit by connection thereto of line, neutral, and sometimes grounding conductors. Typically, the wiring device includes means for connection thereto of the conductors in one or both of two ways, namely, by securing a bare end of the conductor to the appropriate terminal or bus by a screw, and/or by so-called push-wire connection means. A wiring device equipped for push-wire connection typically includes a housing for the electrical components with openings through which the bare ends of the conductors are pushed. A spring clip is positioned inside the housing, adjacent to the opening and urges the end of the conductor inserted through the opening into tight engagement with the terminal or bus.

Push-wire connection of conductors to wiring devices is normally faster and easier than screw-type connection. Once the insulation has been stripped from the end of the conductor, it may be electrically connected to the device simply by insertion through the proper opening. In order to ensure a secure connection, the spring clip which receives the end of the conductor is designed to permit movement of the conductor only in the inward direction. That is, the spring clip is deflected as the end of the conductor is pushed through the opening in the housing, between the clip and the terminal, and engages the conductor in a manner preventing movement in the opposite direction. In order to disconnect the conductor from the device the spring clip must be deflected outwardly to release it from engagement with the conductor.

It is a common practice in conventional wiring devices equipped for push-wire connection to provide an additional opening adjacent each of the openings through which the ends of the conductors may be inserted. A tool such as the tip of a screwdriver, or the like, may be inserted through the additional opening to engage and deflect the spring clip outwardly, causing it to release the end of the conductor and permit its withdrawal from the wiring device. Although providing an effective means for disengaging and removing the conductor, it is possible that the tool may be inserted with excessive force, or in an otherwise improper manner, resulting in damage to the spring clip or other components of the wiring device. Furthermore, the presence of the unobstructed openings for tool insertion raises the possibility that other objects may be inserted through such openings with potential damage to the wiring device and/or electrical shock to the person effecting such insertion.

The prior art includes wiring devices having permanently installed release means for push-wire connections. For example, in some of the disclosed embodiments, U.S. Pat. No. 4,768,976 includes outwardly projecting tabs on a lever which may be pressed to move the spring contact out of gripping engagement with the conductor in a terminal block. In U.S. Pat. No. 3,977,751, the arms of a U-shaped, plastic member engage the springs holding push-wire connections of a portable electric tool switch assembly. U.S. Pat. Nos. 3,152,851 and 4,149,766 both disclose manually operable wire release means integral with a wiring device wherein the operating member is pivotally mounted on the housing or casing. U.S. Pat. No. 3,152,851 also mentions, without providing a specific disclosure, that sliding rather than pivoting movement may be used to transmit the release force.

It is a principal object of the present invention to provide novel and improved means for effecting safe and easy removal of a conductor from a push-wire connection with an electrical terminal.

A further object is to provide an electrical wiring device having means for effecting push-wire connection of conductors, wherein there are no unobstructed openings for insertion of objects to release the conductor connections.

Another object is to provide an electrical wiring device having integrally mounted, reciprocally slidable members which permanently block access to the interior of the device housing through openings in which the members are mounted for selective movement to release push-wire connections of conductors to the device.

Other objects will in part be obvious and will in part appear hereinafter.

SUMMARY OF THE INVENTION

In accordance with the foregoing objects, the invention comprises a wiring device of otherwise conventional design incorporating a reciprocally slidable member mounted in an opening in the device housing for movement to release the end portion of a conductor which is received in a push-wire connection arrangement within the housing. The push-wire termination, as it is commonly known, is of generally conventional design, including a portion in the nature of a leaf spring which may be formed from the same piece of sheet metal comprising the electrical terminal which the conductor is to contact. The spring is so configured and arranged that a portion thereof, normally a free end, is biased toward engagement with a surface of the terminal. The end portion of the wire is inserted through an opening in the housing and passes between the spring and the terminal, flexing the spring away from the terminal and being urged by the spring into tight engagement with the opposing surface of the terminal. The spring is configured to resist movement of the conductor away from the engaged position.

The slidable member is configured cooperatively with the opening wherein it is mounted for movement from an outer to an inner position by pushing the member into the opening with any suitable tool. In so moving, the member contacts and moves the leaf spring out of contact with the conductor, releasing the latter for movement out of the opening in the device housing through which it was originally inserted. The outer end of the member is preferably recessed somewhat into the housing when the member is in its outer position. The member is returned from the inner to the outer position by flexing movement of the spring toward the terminal after removal of the conductor. The foregoing and other features of the invention will be more readily understood and appreciated from the following detailed description, taken in conjunction with the accompanying drawings, wherein:

DETAILED DESCRIPTION

Figure 1:
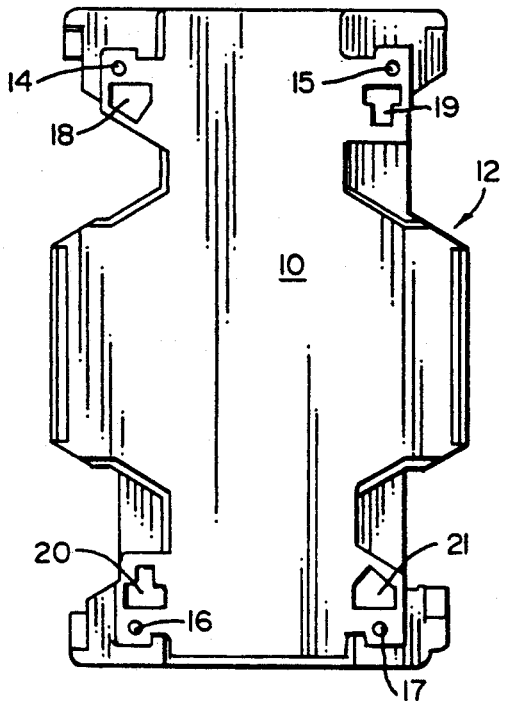
FIG. 1 is an elevational view of the exterior of the rear housing section of a wiring device embodying the invention.
Figure 1A:
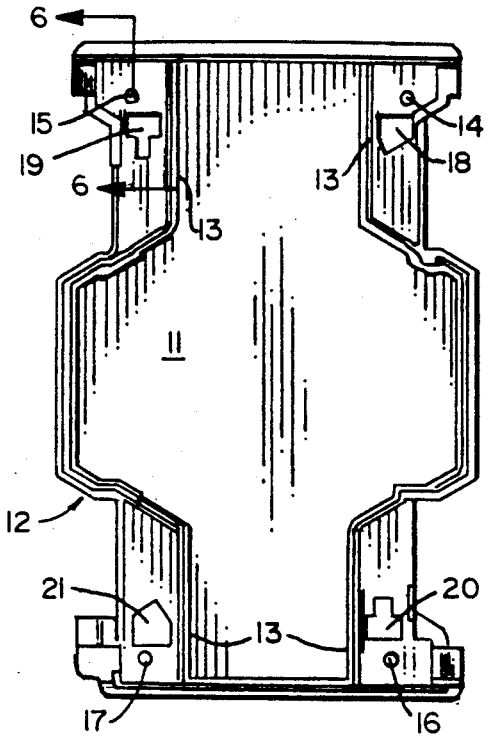
FIG. 1A is an elevational view of the interior of the housing section of FIG. 1.

Referring now to the drawings, in FIGS. 1 and 1A are shown the outer surface 10 and inner surface 11, respectively, of rear section 12 of a housing which forms a portion of a wiring device incorporating the present invention. It will be understood that the invention may be practiced with a wide variety of electrical apparatus, including wall-mounted switches and receptacles, terminal blocks, cord-mounted switches, cube taps, and electrical connections in a panel or wiring box or appliance housing, all of which are intended to be encompassed by the term wiring device, as used herein. For purposes of the present description, the wiring device will be considered to be a wall-mounted, duplex receptacle, rear section 12 being part of a housing configuration typically employed in such devices.

The housing provides an enclosure, normally of molded plastic made in front and rear, mating sections, for the electrical components of the wiring device such as contacts, terminals, etc. In order to connect the device in an electrical circuit, conductors are connected to wiring terminals within the housing. The present invention, as previously mentioned, is concerned with push-wire terminations and means for releasing the conductors from connection thereto, as opposed to screw-type connectors. To this end, rear section 12 is provided adjacent one end with a first pair of through openings 14 and 15 for respective insertion of end portions, from which the insulation has been stripped, of a first pair of conductors. A second pair of through openings 16 and 17 is provided adjacent the opposite side of rear section 12 for like insertion of a second pair of conductors. As the conductors are inserted through the openings, the end portions thereof are received in push-wire terminations, thereby connecting both sets of terminals of the duplex receptacle in the circuit of the conductors, two of which are the load and the other two the line (neutral) wires of the electrical circuit. A third pair of through openings 18 and 19 is positioned adjacent the first pair of openings 14 and 15, respectively. Likewise, a fourth pair of openings 20 and 21 is positioned adjacent openings 16 and 17, respectively. Portions 13 of a peripheral wall extending around the interior of housing section 12 lie immediately adjacent inner edges of each of openings 18–21. Members used to release the conductors from the push-wire terminations are mounted for reciprocal, sliding movement between outer and inner positions in openings 18, 19, 20 and 21, as described later in detail.

Figure 2:
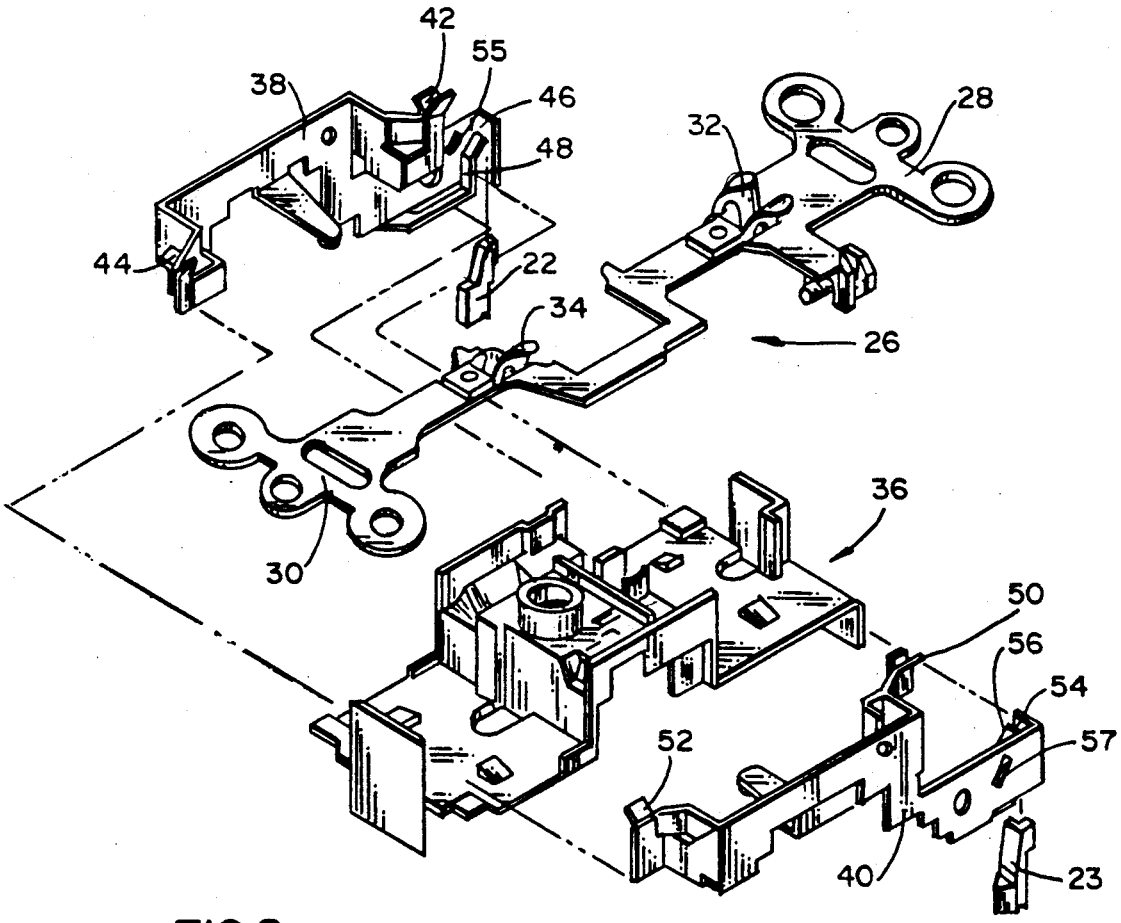
FIGS. 2 and 3 are exploded perspective views showing internal elements of the wiring device.
Figure 3A:
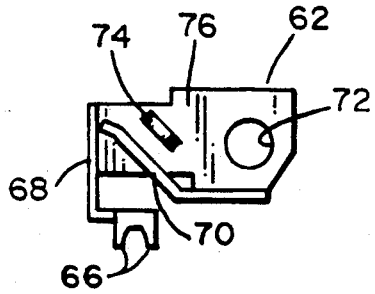
FIG. 3*a* is a front elevational view of one of the components shown in FIG. 3.
Figure 3:
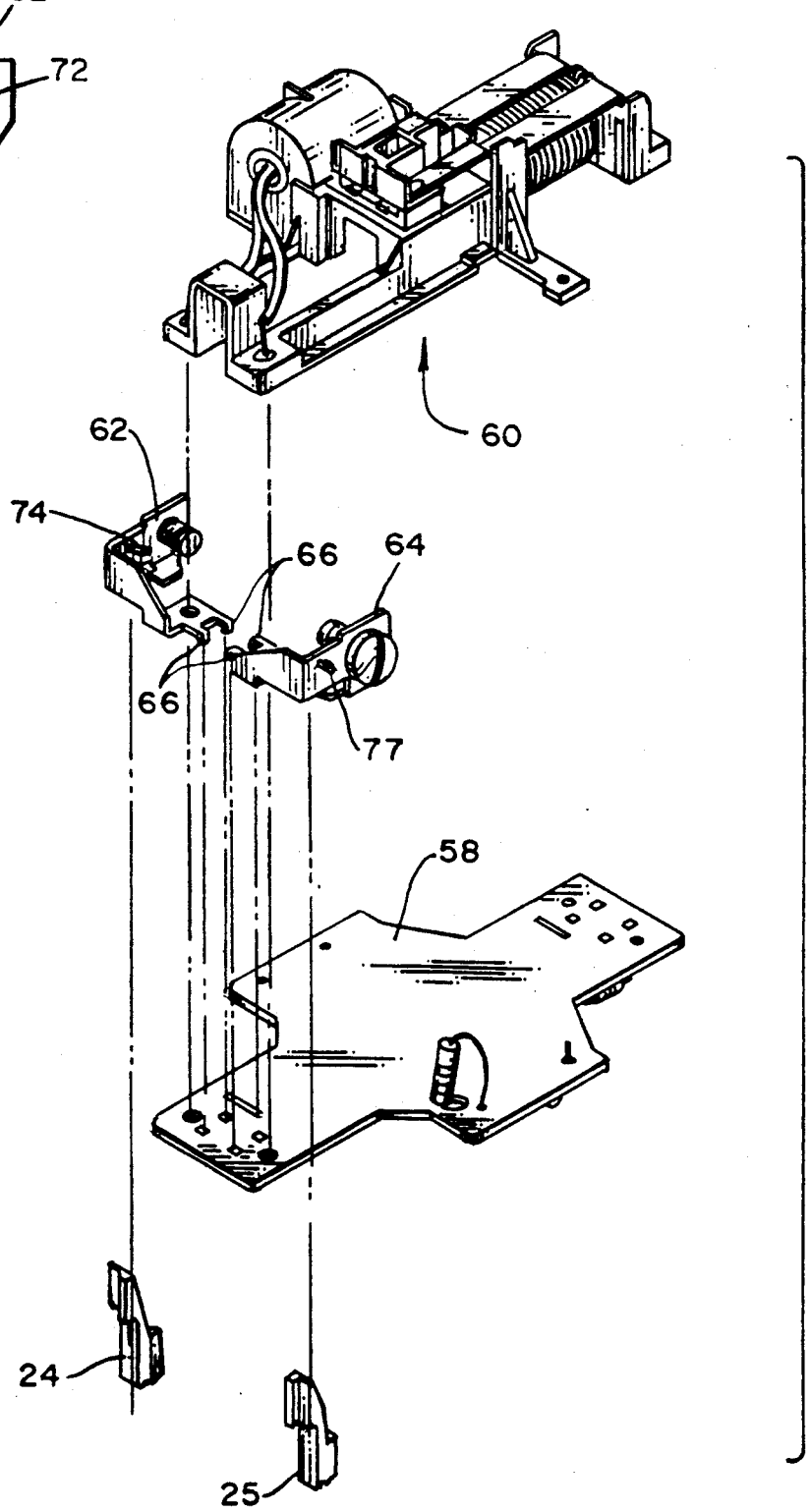

Certain internal elements of the duplex receptacle are shown in exploded perspective in FIGS. 2 and 3, together with the reciprocally movable wire-release members, denoted by reference numerals 22–25, one pair being shown in FIG. 2 and the other in FIG. 3. The duplex receptacle used for illustrative purposes in the present application is of the type more fully illustrated and described in copending application Ser. No. 373,144, the disclosure of which is incorporated herein by reference. The receptacle of the aforementioned application includes ground fault circuit interrupting capability, a feature which may or may not be included in wiring devices which incorporate the present invention.

The elements shown in FIG. 2 include mounting strap or yoke 26, which extends through housing 12, having ears 28 and 30 extending from opposite ends thereof, and contacts 32 and 34 for receiving the ground prongs of electrical plugs connected to the receptacle. Plastic support member 36 is mounted within housing 12 and carries electrically conducting terminals 38 and 40, all as more fully described in the previously referenced application. Terminal 38 includes female contacts 42 and 44 for receiving the prongs of plugs inserted in the receptacle, end tab 46 and spring member 48 having a free end portion biased toward engagement with an opposing surface of tab 46. Terminal 40 is formed in like manner to include contacts 50 and 52, end tab 54 and spring member 56. Terminals 38 and 40 further include portions 55 and 57, respectively, pierced to extend integrally from a wall of each terminal, providing stop means for rearward movement of spring members 48 and 56, respectively, as explained later in more detail. Threaded openings 59 are provided in each of terminals 38 and 40 to receive screws by which conductors may be attached to the terminals alternatively to the push wire terminations. Both terminals 38 and 40 are integrally formed from respective, single pieces of sheet metal, appropriately formed and shaped, with the natural resilience of the material providing the biasing of spring members 48 and 56.

The elements shown in FIG. 3 include circuit board 58, carrying electronic components of a ground fault interrupter circuit which is included in the receptacle used herein for illustrative purposes. A solenoid, movable contact arms, current sensing coils and other elements providing the ground fault circuit interrupting operation are mounted on a plastic member, all indicated generally by reference numeral 60. Terminals 62 and 64 each include a pair of prongs 66 extending through openings in circuit board 58 and solder-connected to the printed circuit on the opposite side thereof.

For greater clarity of illustration, terminal 62 is shown in elevational view in FIG. 3*a*, where it is seen to include wall portion 68 and spring arm 70 having a terminal end biased toward contact with wall portion 68 to provide a push-wire termination. Threaded opening 72 receives a screw by which a conductor may be connected to terminal 62 alternatively to the push-wire termination, if desired. Stop portion 74, limiting travel of spring arm 70 in a direction away from wall portion 68, is pierced from integral wall portion 76, remaining attached thereto at both ends of portion 74. Terminals 62 and 64 are each integrally formed from respective, single pieces of sheet metal, and are mirror images of one another, terminal 64 having stop portion 77, the same as stop portion 74 of terminal 62.

Reciprocally slidable members 22 and 23 are seen in FIG. 2, and members 24 and 25 in FIG. 3. Members 22 and 25 are identical to one another and are configured for mounting and slidable movement in openings 19 and 20, at diagonally opposite corners of rear section 12. Members 23 and 24 are also identical to one another, but not to members 22 and 24, being configured for mounting in openings 18 and 21, at the other two diagonally opposite corners of rear section 12.

One of identical members 22 and 25 is shown in various views in FIGS. 4*a*–4*f*. Upper and lower protrusions 78 and 80, respectively, extend outwardly in opposite directions from the upper and lower ends of central stem portion 82. Lower protrusion 80 has upper surface 81. As best seen in the top and bottom plan views of FIGS. 4*e* and 4*f*, upper protrusion 78 has a side surface 84 which is flush or contiguous with a side surface 86 of stem portion 82. Protrusion 78 does not extend the full width of stem portion 82, leaving open area 88 forwardly of stem portion 82 and laterally of protrusion 78. Lower protrusion 80 is also narrower than stem portion 82, but is more centrally disposed between the sides of the stem.

Figure 4E:
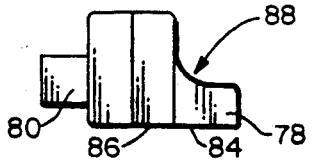
FIGS. 4*a*–4*f* are left side, front, right side and rear elevational, and top and bottom plan views, respectively, of one of the two configurations of slidable members employed in the wiring device of the invention.
Figure 4F:
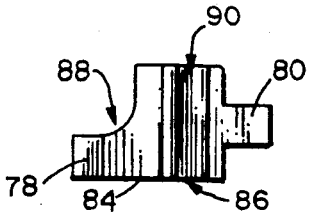
Figure 4D:
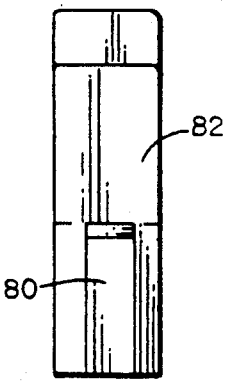
Figure 4A:
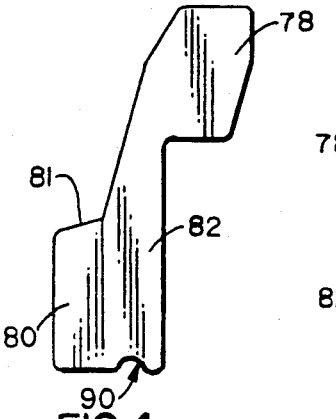
Figure 4B:
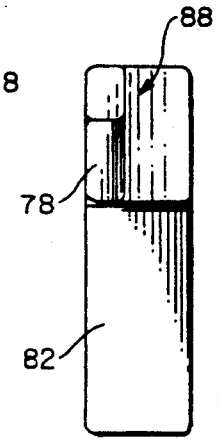
Figure 4C:
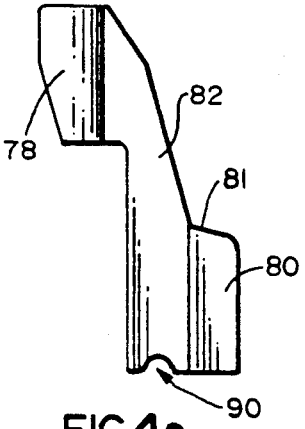

By comparison of FIGS. 1 and 1*a* with FIG. 4*f*, it will be seen that the base or lower portion of members 22 and 25, formed by the lower end of stem portion 82 and lower protrusion 80, is configured to fit in openings 19 and 20 of rear housing section 12. The fit is such that the members may slide freely in and out, but are restrained against lateral or turning movement. Groove 90 extends across the lower end of stem portion 82 for engagement by the blade of a screwdriver or other tool used to move the members inwardly, as explained later in more detail.

One of members 23 and 24 is shown in FIGS. 5*a*–5*f*. As in the case of members 22 and 25, upper and lower protrusions 92 and 94, respectively, extend in opposite directions from stem portion 96. Lower protrusion 94 has upper surface 95. Upper protrusion 92 is flush with one side of stem portion 96, the protrusion being narrower than the stem to provide open area 98 on one side of the protrusion and forwardly of the stem. Lower protrusion 94 is triangular in plan view and extends the full width of stem portion 96 at the juncture of the two. Groove 100 extends across the lower surface of stem portion 96 for the same purpose as groove 90 in stem portion 82. The lower portion of members 23 and 24, i.e., lower protrusion 94 and the adjacent part of stem portion 96, is configured to fit in openings 18 and 21 with the same fit as members 22 and 25 in openings 19 and 20, permitting reciprocal, sliding movement of members 23 and 24.

Figure 6:
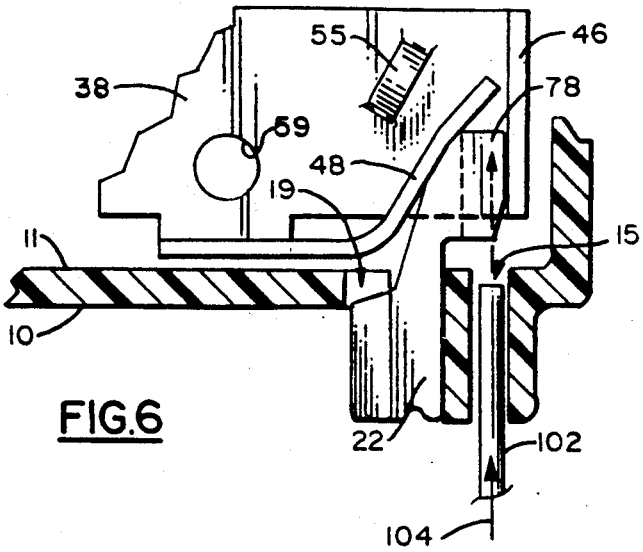
FIGS. 6–8 are a series of enlarged, fragmentary, elevational views in section on the line 6—6 of FIG. 1A showing elements of the wiring device in various positions of movement.
Figure 7:
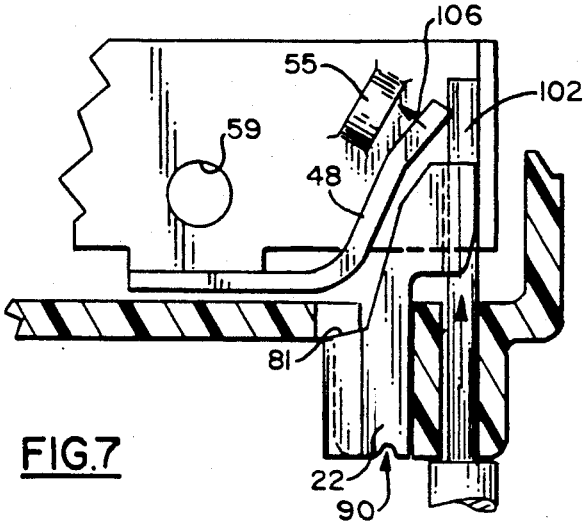
Figure 8:
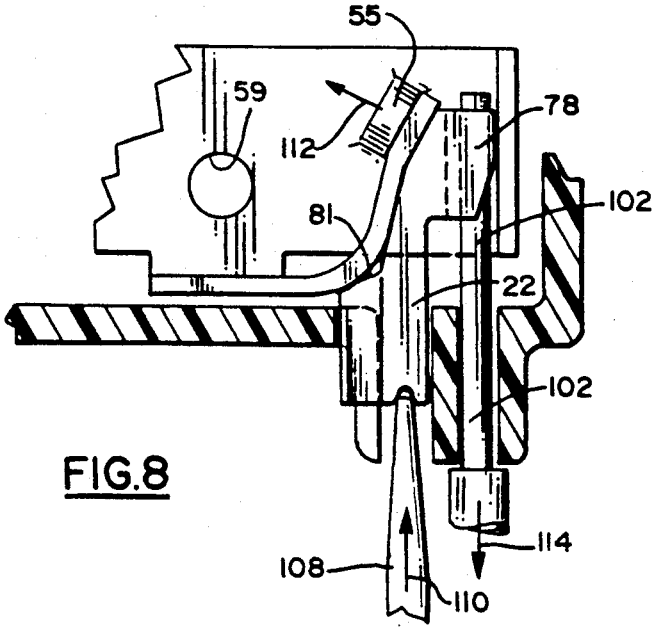

Referring now to FIGS. 6–8, operation of the push-wire terminations and release of conductors engaged therewith may be seen. The operation is essentially the same at all of the four locations in the illustrated wiring device where push-wire terminations are provided. When the wiring device is fully assembled, with the elements of FIGS. 2 and 3 within the housing which includes rear section 12, spring clips 48 and 56 of terminals 38 and 40 are positioned inwardly adjacent openings 14 and 15, respectively. Likewise, spring clips 70 of terminals 62 and 64 are positioned inwardly adjacent openings 16 and 17, respectively. Thus, each of the four spring clips is also positioned inwardly adjacent one of openings 18–21.

Spring clip 48, and a portion of terminal 38 with which it is integrally formed, is shown in FIGS. 6–8, inwardly adjacent openings 15 and 19. In order to connect terminal 38 into a wiring circuit, the bare end of a conductor, indicated by reference numerals 102 is pushed into opening 15 as indicated by arrow 104 in FIG. 6. As conductor 102 is advanced through opening 15, it passes through open area 88, which is behind upper protrusion 78 in the view of FIGS. 6–8, and is forced between the terminal end of spring clip 48 and wall portion 46 of terminal 38, moving the end of the clip away from the wall portion, as indicated by arrow 106 in FIG. 7. In this position, conductor 102 cannot be removed from its operative connection with the terminal.

When it is desired to remove conductor 102 from the wiring device, member 22 is moved inwardly. Due to its small size and position of its exposed end portion within opening 19, such movement is effected with the aid of a small screwdriver or similar tool, an end portion of which is shown in FIG. 8, denoted by reference numeral 108. The tip or blade of tool 108 is placed in groove 90 and inward movement of the tool, as indicated by arrow 110, causes inward, sliding movement of member 22, thereby moving spring clip 48 in the direction of arrow 112. Conductor 102 is no longer engaged between the end of spring clip 48 and wall portion 46, permitting its withdrawal from the wiring device through opening 14 in the direction of arrow 114.

It will be noted that movement of spring clip 48 in a direction away from wall portion 46 is limited by contact with stop member 55, integral with terminal 38. Also, such movement of the spring clip, as well as inward movement of member 22, is limited by contact of upper surface 81 of lower protrusion 94 with the base of the spring clip, as seen in FIG. 8. That is, the elements are preferably so dimensioned and configured that spring clip 48 contacts stop member 55 at substantially the same point in the movement of member 22 that surface 81 contacts the base of the spring clip. Upon removal of tool 108 from contact with member 22, the biasing force of spring clip 48, tending to move the free end thereof toward wall portion 46, will move member 22 back to its position of FIG. 6.

When positioned in openings 19 and 20, side surfaces 84 and 86 (FIG. 4*f*) of members 22 and 25 are in sliding contact with, or very closely adjacent, opposing surfaces of housing wall portions 13. The opposite side surfaces of members 22 and 25 are closely adjacent the inwardly facing surfaces of terminals 38 and 64. The forward surface of upper protrusion 78, as seen in FIGS. 6–8, are in sliding contact with wall portion 46 of terminal 38. Thus, members 22–25 are guided in their reciprocating movement by adjacent, cooperating portions of the wiring device.

Figure 5E:
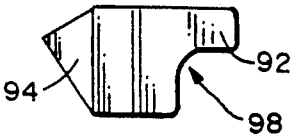
FIGS. 5*a*–5*f* are left side, front, right side and rear elevational, and top and bottom plan views, respectively, of the other of the two configurations of slidable members.
Figure 5F:
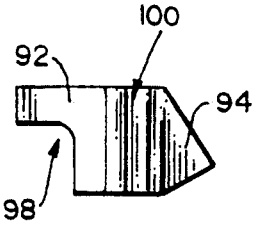
Figure 5D:
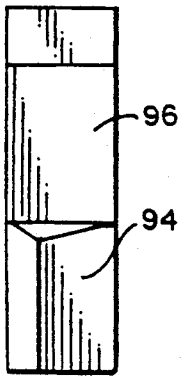
Figure 5A:
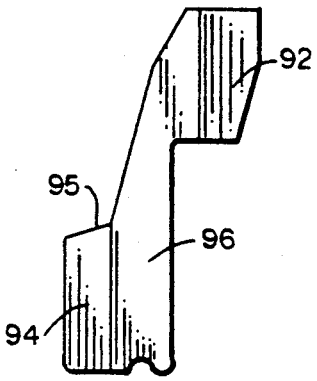
Figure 5B:
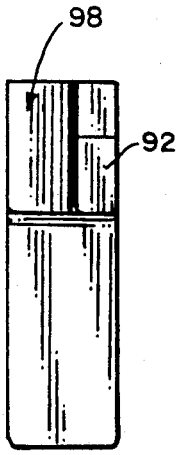
Figure 5C:
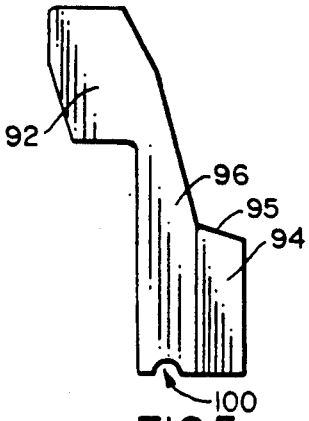

From a comparison of the top and bottom plan views of FIGS. 4*e* and 4*f* with those of FIGS. 5*e* and 5*f*, it is seen that upper protrusion 78 of members 22 and 25 are on the opposite side from upper protrusion 92 of members 22 and 24. This ensures that the necessary clearances for passage of the conductors (i.e., open areas 88 and 98) are properly positioned, and that the flush side surface of the upper protrusions and stem portions will oppose wall portions 13. Thus, the pieces having upper protrusions on opposite sides may be termed "right" and "left" pieces. In order to simplify assembly and ensure the proper pieces are inserted in the correct openings, openings 18 and 21 and the base portions of members 23 and 24 are given a first configuration; openings 19 and 20, and the base portions of members 22 and 25 are given a second configuration.

What is claimed is:

1. In a wiring device having a housing wherein at least one electrical terminal is enclosed, said housing having a first through opening for insertion of an uninsulated end portion of an electrical conductor into said housing, the improvement comprising:

(a) flexible spring means within said housing having a portion biased toward engagement with an opposing surface of said terminal, said spring means being configured to permit axial movement of said conductor end portion in a first direction to a position between and in contact with each of said biased portion and said terminal surface as said conductor end portion is inserted through said first opening, whereby said conductor end portion is biased by said spring means into electrically conducting relation with said terminal surface, and to resist axial movement of said conductor end portion in a second direction, opposite to said first direction;

(b) said housing having a second through opening closely adjacent said first opening; and (c) a member mounted in said second opening for freely reciprocating movement in a predetermined path between outer and inner positions, said member having a central stem portion extending the full length of said member and having a central axis substantially parallel to the axis of said second opening, and an engagement portion comprising an upper protrusion extending forwardly from said stem portion adjacent one end thereof, said upper protrusion including a forwardly disposed surface which slidingly contacts said terminal surface during said reciprocating movement, and said stem portion including a rearwardly disposed surface which contacts and moves said spring means in a direction away from said terminal surface during movement of said member from said outer to said inner position, thereby releasing said conductor from said position between said biased portion of said spring means and said terminal surface to permit movement of said conductor end portion in said second direction, out of said first opening.

2. The invention according to claim 1 wherein said upper protrusion extends laterally of said stem portion for less than the full width thereof, leaving an open area forwardly of said stem portion and laterally of said upper protrusion, said open area lying on the axis of said first opening, whereby said conductor end portion passes through said open area when inserted through said first opening.

3. The invention according to claim 1 wherein said member includes a base portion comprising a lower protrusion extending rearwardly from said stem portion adjacent the end opposite said one end.

4. The invention according to claim 3 wherein the cross-sectional configuration of said base portion, including said lower protrusion and the adjacent portion of said stem portion, is substantially the same as the cross-sectional configuration of said second opening.

5. The invention according to claim 4 wherein said lower protrusion includes an upper surface which engages a portion of said spring means to limit movement of said member to said inner position.

6. A wiring device for connection with uninsulated end portions of load and line conductors of an electrical circuit by push-wire terminations, said device comprising:

(a) a housing wall having a first pair of through openings for insertion and withdrawal of respective ones of said conductor end portions, and a second pair of through openings, one of said second openings lying in closely spaced relation to a respective one of said first openings;

(b) load and line terminals each having a surface closely adjacent a respective one of said first pair of openings;

(c) first and second flexible spring means each having a portion biased toward engagement with a respective one of said terminal surfaces, each of said spring means being configured to permit axial insertion of a respective one of said conductor end portions through each of said first openings to positions between and in contact with said biased spring portions and said terminal surfaces, whereby said load and line conductor end portions are held by said biased spring portions in electrically conducting relation with said load and line terminal surfaces, respectively, and to resist withdrawal of said conductor end portions out of said first openings;

(d) first and second spring release members each having a base portion mounted in a respective one of said second openings for reciprocal sliding movement between inner and outer positions, a central stem portion, and a protrusion extending laterally outwardly from said stem portion which contacts and moves said biased spring portion in a direction away from said terminal surface upon movement of said base portion to said inner position, thereby permitting withdrawal of said conductor end portions from said first pair of openings, said protrusions extending laterally of said stem portions for less than the full width thereof, leaving an open area forwardly of said stem portions and laterally of said protrusions, said open areas respectively lying on the axis of said first pair of openings, whereby said conductor end portions pass through said open areas when respectively inserted through said first pair of openings, the positions of said protrusions and said open areas being reversed on said pair of spring release members; and (e) said base portions of said first and second spring release members having different cross sectional configurations, corresponding to the respective cross sectional configurations of said second pair of openings.

7. The invention according to claim 6 wherein said protrusions are in different orientations with respect to said stem portions of the respective spring release members.

8. A wiring device for connection with uninsulated end portions of load and line conductors of an electrical circuit by push-wire terminations, said device comprising:

(a) a housing wall having a first pair of through openings for insertion and withdrawal of respective ones of said conductor end portions and a second pair of through openings, one of said second openings lying in closely spaced relation to a respective one of said first openings;

(b) load and line terminals each having a surface closely adjacent a respective one of said first pair of openings;

(c) first and second flexible spring means each having a portion biased toward engagement with a respective one of said terminal surfaces, each of said spring means being configured to permit axial insertion of a respective one of said conductor end portions through each of said first openings to positions between and in contact with said biased spring portions and said terminal surfaces, whereby said load and line conductor end portions are held by said biased spring portions in electrically conducting relation with said load and line terminal surfaces, respectively, and to resist withdrawal of said conductor end portions out of said first openings;

(d) first and second spring release members each having a central stem portion, a base portion mounted in a respective one of said second openings for reciprocal sliding movement between inner and outer positions, and an engagement portion which contacts and moves said biased spring portion in a direction away from said terminal surface upon movement of said base portion to said inner position, thereby permitting withdrawal of said conductor end portion from said first pair of openings; and (e) said protrusions being in different orientations with respect to said stem portions of the respective spring release members, said protrusions extending laterally of said stem portions for less than the full width thereof, leaving an open area forwardly of said stem portions and laterally of said protrusions, said open areas respectively lying on the axis of said first pair of openings, whereby said conductor end portions pass through said open areas when respectively inserted through said first pair of openings, the positions of said protrusions and said open areas being reversed on said pair of spring release members.

9. The invention according to claim 8 wherein said base portions extend laterally outwardly from the side of said stem portions opposite that from which said protrusions extend.

* * * * *